US011027797B1

(12) United States Patent
Uozumi et al.

(10) Patent No.: US 11,027,797 B1
(45) Date of Patent: Jun. 8, 2021

(54) PERSONAL WATERCRAFT

(71) Applicant: KAWASAKI JUKOGYO KABUSHIKI KAISHA, Kobe (JP)

(72) Inventors: Yoshinobu Uozumi, Akashi (JP); Hideaki Ebisui, Kakogawa (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/730,144

(22) Filed: Dec. 30, 2019

(51) Int. Cl.
*B63B 34/10* (2020.01)
*B63B 19/14* (2006.01)

(52) U.S. Cl.
CPC ..... *B63B 34/10* (2020.02); *B63B 19/14* (2013.01)

(58) Field of Classification Search
CPC ..... B63B 34/10; B63B 19/14
See application file for complete search history.

(56) References Cited

U.S. PATENT DOCUMENTS 5,894,810 A * 4/1999 Orr ..... B60R 11/0217 114/343
6,125,782 A * 10/2000 Takashima ..... B63B 49/00 114/343
6,530,336 B2 * 3/2003 Ibata ..... B63B 25/002 114/55.5
7,131,876 B2 * 11/2006 Hattori ..... B63B 34/10 440/1
7,186,154 B2 * 3/2007 Takashima ..... B63J 99/00 114/55.51
8,751,158 B2 * 6/2014 Kamio ..... B63B 34/10 701/444
8,753,154 B2 * 6/2014 Fujino ..... B63H 25/04 440/1
10,611,438 B1 * 4/2020 Araki ..... B63B 34/10
2002/0053310 A1 * 5/2002 Ibata ..... B63B 19/14 114/55.53
2005/0003716 A1 * 1/2005 Takashima ..... B63J 99/00 440/85

FOREIGN PATENT DOCUMENTS

JP 2007261545 A 10/2007

OTHER PUBLICATIONS

US 10,787,230 B2, 09/2020, Montague (withdrawn)*

* cited by examiner

*Primary Examiner* — S. Joseph Morano
*Assistant Examiner* — Jovon E Hayes
(74) *Attorney, Agent, or Firm* — Alleman Hall Creasman & Tuttle LLP

(57) ABSTRACT

A personal watercraft includes: a watercraft body made of a resin; a handle projecting upward from the watercraft body; a meter display device disposed above the watercraft body and forward of the handle; a meter cover made of a resin and covering a space from above, the space being adjacent to and forward of the meter display device and being in contact with an upper surface of the watercraft body and a forward surface of the meter display device; and an antenna disposed in the space.

8 Claims, 4 Drawing Sheets

PERSONAL WATERCRAFT

BACKGROUND OF THE INVENTION

1. Field of the Invention

The present disclosure relates to a personal watercraft configured to plane on water by jetting water rearward from a water jet pump.

2. Description of the Related Art

Personal watercrafts (PWCs) are widely used for leisure, sports, and rescue activities. In a common personal watercraft, water drawn through a water inlet port provided in a bottom surface of the body of the watercraft is pressurized and accelerated by a water jet pump driven by the engine of the watercraft, and the water is jetted rearward to propel the body of the watercraft.

Personal watercrafts may be required to have multiple functions for improving the user-friendliness and other properties. For example, it is conceivable to provide external communication function to a personal watercraft. In this case, depending on the type of the function, careful consideration needs to be given to avoid poor sensitivity of an antenna mounted for communication.

SUMMARY OF THE INVENTION

An object of the present disclosure is to ensure good sensitivity of an antenna mounted on a personal watercraft.

A personal watercraft according to one aspect of the present disclosure includes: a watercraft body made of a resin; a handle projecting upward from the watercraft body; a meter display device disposed above the watercraft body and forward of the handle; a meter cover made of a resin and covering a space from above, the space being adjacent to and forward of the meter display device and being in contact with an upper surface of the watercraft body and a forward surface of the meter display device; and an antenna disposed in the space.

In the above configuration, the antenna is disposed in that front portion of the watercraft body which includes few components acting as obstacles to the antenna, and the meter cover disposed above the antenna and the watercraft body's front portion disposed forward of the antenna are each made of a resin. As such, good sensitivity of the antenna can be ensured.

The above and further objects, features and advantages of the present disclosure will be more apparent from the following detailed description of preferred embodiments with reference to the accompanying drawings.

DETAILED DESCRIPTION OF THE EMBODIMENTS

Hereinafter, an embodiment will be described with reference to the drawings.

Figure 1:
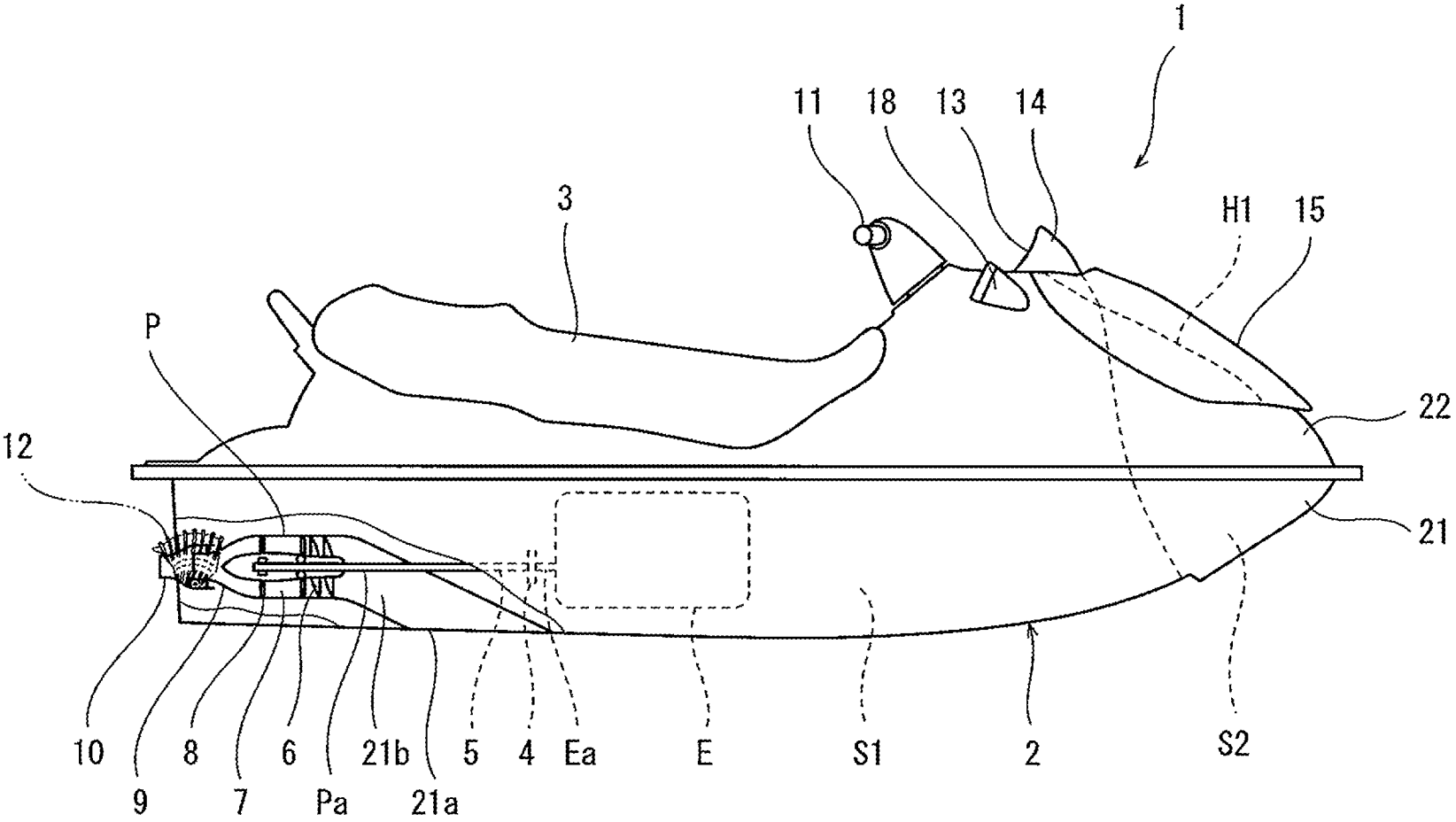
FIG. 1 is a partially cutaway side view of a personal watercraft according to an embodiment.
Figure 2:
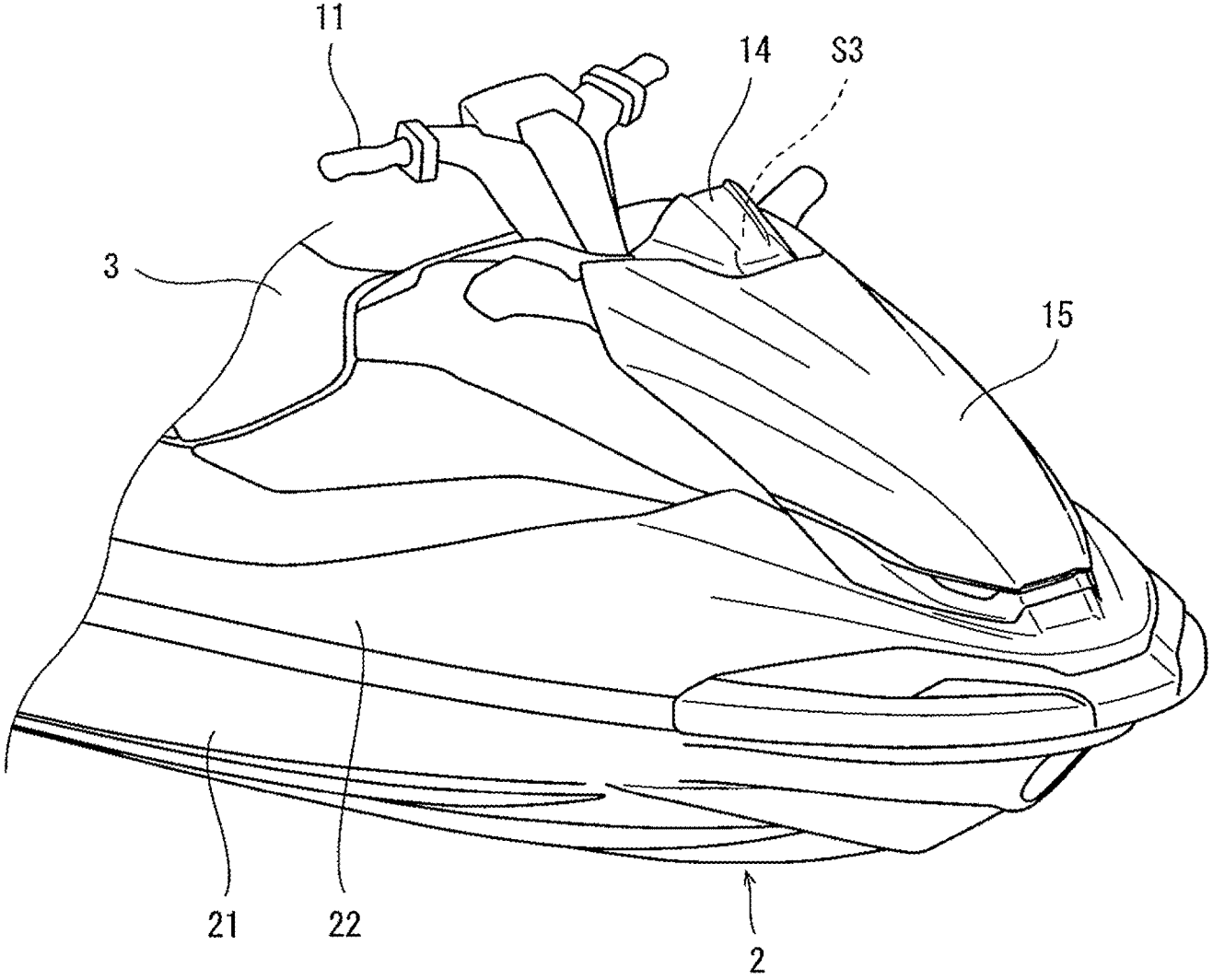
FIG. 2 is a right front perspective view of a front portion of the personal watercraft shown in FIG. 1.

FIG. 1 is a partially cutaway side view of a personal watercraft 1 according to the embodiment. FIG. 2 is a right front perspective view of the personal watercraft 1 shown in FIG. 1. As shown in FIGS. 1 and 2, the personal watercraft 1 includes a watercraft body 2 made of a resin which is electrically non-conductive. The watercraft body 2 includes a hull 21 and a deck 22 covering the top of the hull 21. The deck 22 is provided with a seat 3 on which the rider sits in a straddling position. The interior of the watercraft body 2 includes an engine accommodation space S1 and a front accommodation space S2 disposed forward of the engine accommodation space S1. The engine accommodation space S1 accommodates an engine E as a prime mover. The front accommodation space S2 can accommodate, for example, the user's possessions.

The engine E includes an output shaft Ea, which extends toward the rear of the watercraft body 2. The output end of the output shaft Ea is connected to a propeller shaft 5 via a coupling member 4. A water jet pump P is disposed in a rear portion of the hull 21, and the water jet pump P is located at the center of the hull 21 in the leftward/rightward direction. The water jet pump P includes a pump shaft Pa, to which the propeller shaft 5 is connected. Thus, the pump shaft Pa rotates in conjunction with the rotation of the output shaft Ea. An impeller 6 is mounted on the pump shaft Pa, and a stator vane 7 is disposed rearward of the impeller 6. A pump casing 8 of tubular shape is provided around the outer periphery of the impeller 6 so as to enclose the impeller 6.

A water inlet port 21*a* opens at the bottom of the watercraft body 2. The water inlet port 21*a* is in communication with the pump casing 8 through a water inlet passage 21*b*. A pump nozzle 9 is provided in the rear portion of the watercraft body 2 and connected to the pump casing 8. The diameter of the pump nozzle 9 decreases from front to rear, and a jet orifice opens at the rear end of the pump nozzle 9. A steering nozzle 10 is connected to the jet orifice of the pump nozzle 9, and the steering nozzle 10 is swingable to the left and right.

In the personal watercraft 1, water drawn through the water inlet port 21*a* provided in the bottom of the hull 21 is pressurized and accelerated by rotational power of the impeller 6 of the water jet pump P driven by the engine E. The stream of water is conditioned by the stator vane 7 and vigorously discharged rearward through the jet orifice of the pump nozzle 9 and the steering nozzle 10. Thus, the personal watercraft 1 is propelled by a reaction force from the water jetted out from the water jet pump P through the steering nozzle 10.

A steering handle 11 to be held by the rider is disposed forward of the seat 3. The handle 11 projects upward from the watercraft body 2. The handle 11 is connected to the steering nozzle 10 by a steering cable (not illustrated). When the handle 11 is tilted to the left or right, the steering nozzle 10 swings to the left or right in conjunction with the tilt of the handle 1. A reverse bucket 12 for backward movement of the watercraft is disposed in the vicinity of the steering nozzle 10, and the reverse bucket 12 is swingable upward and downward.

The front portion of the deck 22 is provided with a main opening H1 through which the front accommodation space S2 formed within the watercraft body 2 is open upward. The deck 22 is provided with a meter display device 13 located rearward of the main opening H1 and forward of the handle 11. The meter display device 13 is covered from above by the meter cover 14. A hatch cover 15 which closes the main opening H1 from above is disposed forward of the meter cover 14, and the hatch cover 15 can be freely opened and closed. The meter cover 14 and the hatch cover 15 are each made of a resin which is electrically non-conductive. The deck 22 is provided with a pair of side mirrors 18 projecting outward in the leftward/rightward direction.

Figure 3:
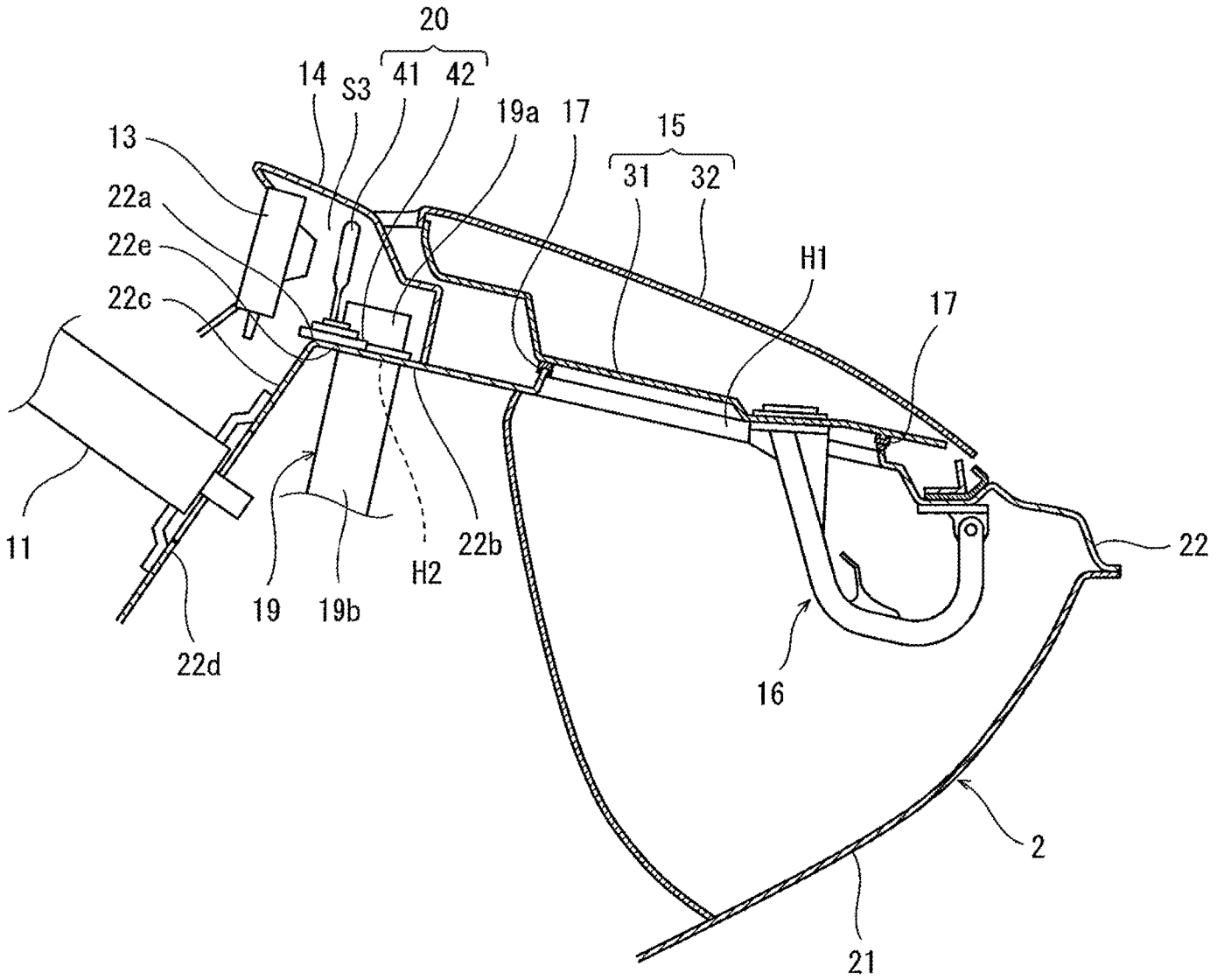
FIG. 3 is a longitudinal cross-sectional side view of the personal watercraft's front portion shown in FIG. 2.
Figure 4:
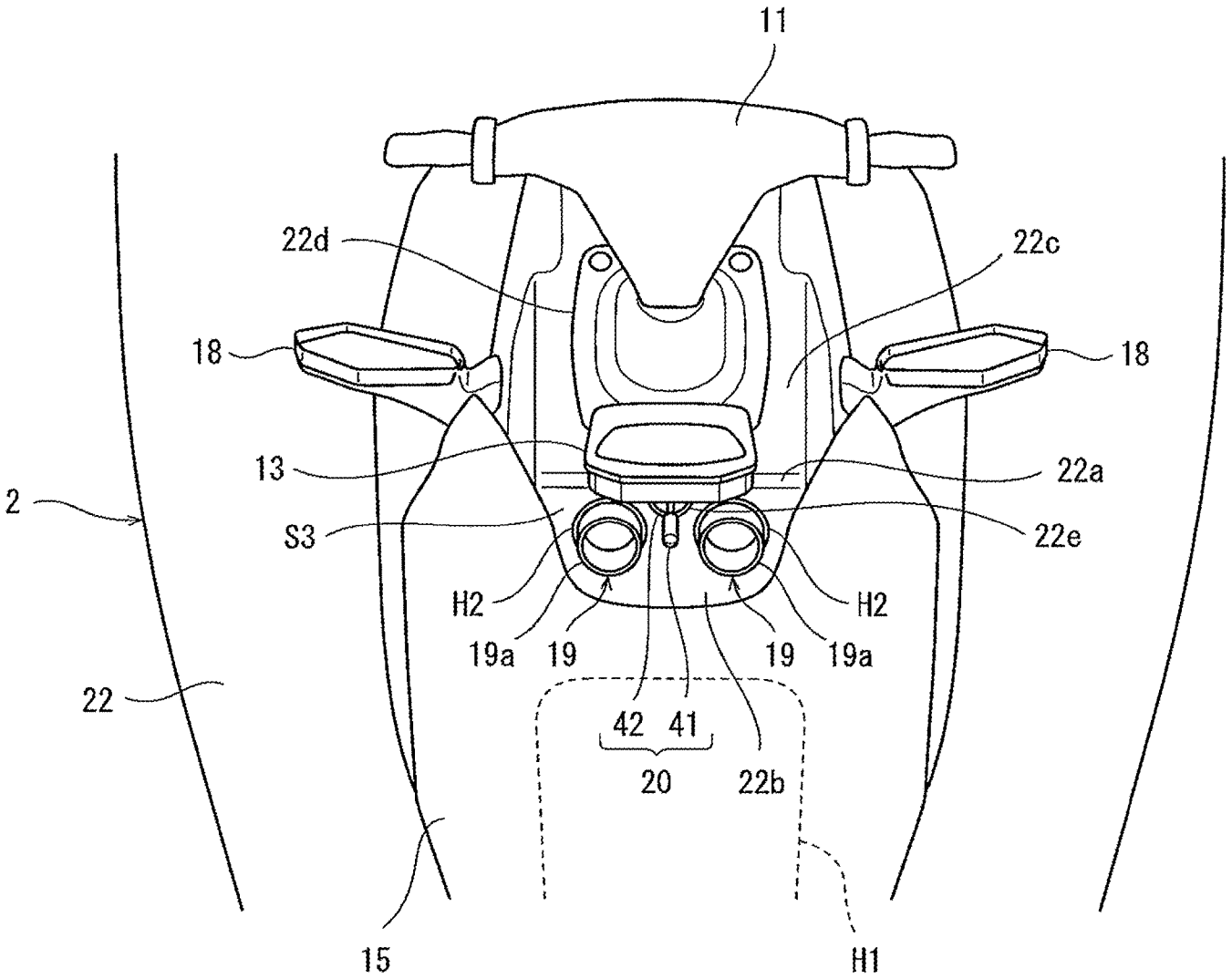
FIG. 4 is a plan view of the personal watercraft's front portion shown in FIG. 2, with a meter cover removed.

FIG. 3 is a longitudinal cross-sectional side view of the personal watercraft 1's front portion shown in FIG. 2. FIG. 4 is a plan view of the personal watercraft 1's front portion shown in FIG. 2, with the meter cover 14 removed. As shown in FIGS. 3 and 4, the deck 22 of the watercraft body 2 includes an apex portion 22*a*, a front inclined surface 22*b*, and a rear inclined surface 22*c*. The apex portion 22*a* is the highest portion of the watercraft body 2 and is located forward of the handle 11. The front inclined surface 22*b* is adjacent to the apex portion 22*a* and extends forward and downward from the apex portion 22*a*. The rear inclined surface 22*c* is adjacent to the apex portion 22*a* and extends rearward and downward from the apex portion 22*a*. The main opening H1, through which the front accommodation space S2 inside the watercraft body 2 is open upward, is formed in the front inclined surface 22*b* of the deck 22. The main opening H1 as viewed in plan is substantially rectangular and is longer in the forward/rearward direction than in the leftward/rightward direction.

The hatch cover 15 is constituted by an inner panel 31 facing the main opening H1 of the front portion of the deck 22 and an outer panel 32 placed over the inner panel 31 in such a manner that an internal space is formed between the inner panel 31 and the outer panel 32, the inner and outer panels 31 and 32 being assembled together. The inner panel 31 of the hatch cover 15 is provided with a first sealing member 17 configured to seal a gap between a peripheral portion of the main opening H1 and the hatch cover 15 when the hatch cover 15 is in a closed state where the hatch cover 15 closes the opening. The hatch cover 15 is coupled to the deck 22 by a hinge device 16 so as to be movable to open and close the main opening H1. The hinge device 16 allows the hatch cover 15 to be opened in such a manner that the rear of the hatch cover 15 is moved obliquely upward and forward.

The front inclined surface 22*b* of the deck 22 is further provided with a pair of auxiliary openings H2. The paired auxiliary openings H2 are disposed between the main opening H1 and the apex portion 22*a* and are arranged in the leftward/rightward direction. Each of the auxiliary openings H2 is smaller than the main opening H1 and is circular in plan view. Intake ducts 19 are fitted into the paired auxiliary openings H2, respectively. The paired intake ducts 19 are made of a resin which is electrically non-conductive. The paired intake ducts 19 are inserted in the paired auxiliary openings H2, respectively. Each of the intake ducts 19 includes an inlet portion 19*a* projecting upward from the front inclined surface 22*b* and a guide portion 19*b* projecting downward from the front inclined surface 22*b* and connected to the air-intake port of the engine E (see FIG. 1) in the engine accommodation space S1.

The meter display device 13 is supported by the rear inclined surface 22*c*. The meter display device 13 is disposed above the watercraft body 2 and is located at a higher level than the apex portion 22*a*. The meter display device 13 is disposed to extend obliquely upward and forward. A space S3 is adjacent to and forward of the meter display device 13, and the meter cover 14 covers the meter display device 13 and the adjacent space S3 from above. The adjacent space S3 is defined by the front inclined surface 22*b* of the deck 22, the forward surface of the meter display device 13, and the inner surface of the meter cover 14. The inlet portions 19*a* of the pair of intake ducts 19 are disposed in the adjacent space S3.

An antenna device 20 is disposed in the space S3 adjacent to and forward of the meter display device 13. The antenna device 20 is used for reception by a communication device (e.g., a radio) mounted on the personal watercraft 1. The antenna device 20 includes an antenna 41 which is substantially rod-shaped and an antenna support base 42 supporting the antenna 41. The deck 22 includes a handle connection portion 22*d* to which the handle 11 is connected, and the handle connection portion 22*d* is provided in the rear inclined surface 22*c*. The deck 22 includes an antenna mounting portion 22*e* on which the antenna device 20 is mounted, and the antenna mounting portion 22*e* is provided in the front inclined surface 22*b*.

The antenna 41 is supported by the front inclined surface 22*b* of the deck 22. The antenna mounting portion 22*e* is located at a higher level than the handle connection portion 22*d*. The antenna support base 42 is fixed to the antenna mounting portion 22*e*, and the antenna 41 projects upward from the antenna support base 42. That is, the antenna 41 as viewed from the antenna mounting portion 22*e* projects upward.

When the personal watercraft 1 is at rest, the antenna 41 projects obliquely upward and forward. The antenna 41 extends along the direction in which the meter display device 13 extends. The antenna 41 is supported by a portion of the front inclined surface 22*b* of the deck 22, the portion being closer to the apex portion 22*a* than is the center of the auxiliary opening H2. The upper end of the antenna 41 as viewed in plan is located forward of the meter display device 13. The rear portion of the antenna support base 42 as viewed in plan is covered by the meter display device 13.

The antenna device 20 is disposed between the inlet portions 19*a* of the pair of intake ducts 19 in the leftward/rightward direction. The antenna device 20 is located at the center of the watercraft body 2 in the leftward/rightward direction. At or above the level of the upper end of the antenna 41, only the meter cover 14 and hatch cover 15 lie ahead of the antenna 41; that is, there is not any electrically conductive member (e.g., a metal member) located forward of the antenna 41 and at or above the level of the upper end of the antenna 41. In the present embodiment, the components located forward of the antenna 41 and at or above the level of the lower end of the antenna 41 are only the meter cover 14 and the hatch cover 15.

In the configuration described above, the antenna 41 is disposed in the front portion of the watercraft body 2 which includes few components acting as obstacles to the antenna 41, and the meter cover 14 disposed above the antenna 41, the hatch cover 15 disposed forward of the antenna 41, and the deck 22's front portion disposed forward of the antenna 41 are each made of a resin. As such, good sensitivity of the antenna 41 can be ensured.

Additionally, the antenna mounting portion 22*e* is located at a higher level than the handle connection portion 22*d*, and the antenna 41 projects upward from the antenna mounting portion 22*e*. As such, the antenna 41 is located at a high level relative to the watercraft body 2, and thus good receiving sensitivity can be ensured.

Additionally, the antenna 41 projects obliquely upward and forward when the personal watercraft 1 is at rest. As such, when the personal watercraft 1 is moving with the watercraft body 2 tilted backward, the direction of the antenna 41 is close to the vertical direction. Thus, high receiving sensitivity of the antenna 41 can be ensured during the movement of the personal watercraft 1.

Additionally, the meter display device 13 is supported by the rear inclined surface 22*c* of the deck 22, and the antenna 41 is supported by the front inclined surface 22*b* of the deck 22. As such, the meter display device 13 and the antenna 41 can be arranged in a suitable manner such that the meter display device 13 and the antenna 41 do not interfere with each other.

In the configuration described above, the main opening H1 and auxiliary openings H2 are provided in the front inclined surface 22*b* of the deck 22, and the front inclined surface 22*b* has only a small area available for mounting of the antenna 41. In such a configuration, the antenna 41 is disposed close to the apex portion 22*a* of the deck 22 and hence to the meter display device 13. Nevertheless, since the upper end of the antenna 41 as viewed in plan is located forward of the meter display device 13, good sensitivity of the antenna 41 can be ensured without interference of the meter display device 13.

Additionally, the antenna 41 is disposed between the inlet portions 19*a* of the pair of intake ducts 19 in the leftward/rightward direction; that is, the antenna 41 is surrounded on both sides by the inlet portions 19*a* of the intake ducts 19 made of a resin. As such, the antenna 41 can be protected while ensuring good sensitivity of the antenna 41.

Many modifications and other embodiments of the present invention will be apparent to those skilled in the art from the foregoing description. Accordingly, the foregoing description is to be construed as illustrative only, and is provided for the purpose of teaching those skilled in the art the best mode for carrying out the invention. The details of the structure and/or function may be varied substantially without departing from the scope of the invention.

What is claimed is:

1. A personal watercraft comprising:

a watercraft body made of a resin;

a handle projecting upward from the watercraft body;

a meter display device disposed above the watercraft body and forward of the handle;

a meter cover made of a resin and covering a space from above, the space being adjacent to and forward of the meter display device and being in contact with an upper surface of the watercraft body and a forward surface of the meter display device; and an antenna disposed in the space, wherein the antenna projects obliquely upward and forward when the personal watercraft is at rest.

2. The personal watercraft according to claim 1, wherein the watercraft body comprises a handle connection portion to which the handle is connected and an antenna mounting portion on which the antenna is mounted, the antenna mounting portion is located at a higher level than the handle connection portion, and the antenna projects upward from the antenna mounting portion.

3. A personal watercraft comprising:

a watercraft body made of a resin;

a handle projecting upward from the watercraft body;

a meter display device disposed above the watercraft body and forward of the handle;

a meter cover made of a resin and covering a space from above, the space being adjacent to and forward of the meter display device and being in contact with an upper surface of the watercraft body and a forward surface of the meter display device; and an antenna disposed in the space, wherein the watercraft body comprises an apex portion which is the highest portion of the watercraft body, a front inclined surface adjacent to the apex portion and extending forward and downward from the apex portion, and a rear inclined surface adjacent to the apex portion and extending rearward and downward from the apex portion, the meter display device is supported by the rear inclined surface, and the antenna is mounted on the front inclined surface.

4. A personal watercraft comprising:

a watercraft body made of a resin;

a handle projecting upward from the watercraft body;

a meter display device disposed above the watercraft body and forward of the handle;

a meter cover made of a resin and covering a space from above, the space being adjacent to and forward of the meter display device and being in contact with an upper surface of the watercraft body and a forward surface of the meter display device;

an antenna disposed in the space; and a hatch cover made of a resin, the hatch cover being mounted on a front portion of the watercraft body and located forward of the meter cover, wherein the front inclined surface of the watercraft body is provided with a main opening through which an accommodation space inside the watercraft body is open upward, the main opening being closable by the hatch cover, the front inclined surface is further provided with at least one auxiliary opening into which at least one intake duct is fitted, the auxiliary opening being located between the main opening and the apex portion, the meter display device is disposed to extend obliquely upward and forward, the antenna is supported by a portion of the front inclined surface, the portion being closer to the apex portion than is a center of the auxiliary opening, the antenna extends along a direction in which the meter display device extends, and an upper end of the antenna as viewed in plan is located forward of the meter display device.

5. The personal watercraft according to claim 4, wherein the at least one auxiliary opening comprises a pair of auxiliary openings arranged in a leftward/rightward direction, the at least one intake duct comprises a pair of intake ducts made of a resin, the intake ducts are inserted in the auxiliary openings, respectively, each of the intake ducts comprises an inlet portion projecting upward from the front inclined surface, and the antenna is disposed between the inlet portions of the intake ducts in the leftward/rightward direction.

6. The personal watercraft according to claim 3, wherein the space is defined by a front inclined surface, a front surface of the meter display device and an inner surface of the meter cover.

7. The personal watercraft according to claim 3, wherein the watercraft body comprises a handle connection portion to which the handle is connected and an antenna mounting portion on which the antenna is mounted, the antenna mounting portion is located at a higher level than the handle connection portion, and the antenna projects upward from the antenna mounting portion.

8. The personal watercraft according to claim 4, wherein the watercraft body comprises a handle connection portion to which the handle is connected and an antenna mounting portion on which the antenna is mounted, the antenna mounting portion is located at a higher level than the handle connection portion, and the antenna projects upward from the antenna mounting portion.

* * * * *